US005221374A

United States Patent [19]

Blondeau et al.

[11] Patent Number: 5,221,374

[45] Date of Patent: Jun. 22, 1993

[54] PROCESS FOR IMPROVING THE HYDROGEN CRACKING RESISTANCE OF LOW- OR INTERMEDIATE-ALLOY STEELS, AND PIECES OBTAINED

[75] Inventors: Régis Blondeau; Jean Beguinot; Philippe Bourges, all of Le Creusot; Lionel Coudreuse, Le Breuil; Gilbert Primon, Saint Vallier; Jacques Charles, Le Breuil, all of France

[73] Assignee: Creusot Loire Industrie, Puteaux, France

[21] Appl. No.: 762,005

[22] PCT Filed: Feb. 11, 1991

[86] PCT No.: PCT/FR91/00102

§ 371 Date: Dec. 16, 1991

§ 102(e) Date: Dec. 16, 1991

[87] PCT Pub. No.: WO91/12351

PCT Pub. Date: Aug. 22, 1991

[30] Foreign Application Priority Data

Feb. 14. 1990 [FR] France ..... 90 01758

[51] Int. Cl.[5] ..... C22C 38/10; C21D 1/28

[52] U.S. Cl. ..... 148/335; 148/662; 148/663; 148/538

[58] Field of Search ..... 148/335, 12 R, 538, 148/662, 663; 420/106, 107

[56] References Cited

U.S. PATENT DOCUMENTS

| | | | |
|---|---|---|---|
| 3,155,500 | 11/1964 | Anthony, III et al. | 420/107 |
| 3,615,370 | 10/1971 | Ridal | 420/106 |
| 4,407,681 | 10/1983 | Ina et al. | 148/331 |

FOREIGN PATENT DOCUMENTS

| | | |
|---|---|---|
| 0021349 | 1/1981 | European Pat. Off. . |
| 626814 | 9/1927 | France . |
| 1570294 | 6/1969 | France . |
| 404565 | 1/1934 | United Kingdom . |
| 734676 | 8/1955 | United Kingdom . |

*Primary Examiner*—Deborah Yee

*Attorney, Agent, or Firm*—Cushman, Darby & Cushman

[57] ABSTRACT

The agent in question is cobalt added in contents of between 0.05% and 2% to steels containing from 0.05% to 0.6% of carbon and less than 10% of alloying elements taken from silicon, manganese, nickel, chromium and molybdenum, to produce optionally normalized blocks, plates, bars or pieces of large size, with improved hydrogen cracking resistance and with improved weld-ability and suitability for thermal cutting. The invention also relates to a process for employing the agent and to the pieces thus obtained.

8 Claims, 3 Drawing Sheets

PROCESS FOR IMPROVING THE HYDROGEN CRACKING RESISTANCE OF LOW- OR INTERMEDIATE-ALLOY STEELS, AND PIECES OBTAINED

The present invention relates to an agent for improving the hydrogen cracking resistance of low-alloy boiler forging and/or structural steels which can be employed especially in hydrogen-containing media such as $H_2S$-enriched gases and also for improving the weldability of these steels and their suitability for gas cutting or for cutting with a plasma torch.

It is well known that steel is sensitive to the presence of hydrogen, which can give rise to unacceptable cracking. This hydrogen can result from the manufacture of steel or can be introduced by a mechanism of the corrosion type, in particular when the steel is employed in a medium containing $H_2S$, or during welding or cutting operations using conventional gas or plasma torch cutting.

This sensitivity of the steel is accentuated by the presence of segregated regions containing more carbon and alloying elements than the average composition.

These segregated regions are all the more important when the steel is employed in the form of bulky products, for example sheets whose thickness ranges from 5 mm to several hundred millimetres.

To reduce this sensitivity of the steel to hydrogen cracking, a person skilled in the art knows that it is necessary, in combination or separately, to reduce non-metallic inclusions as much as possible, to reduce the content of alloying elements to the minimum contents needed to obtain the desired mechanical characteristics and, preferably, to perform a heat treatment of quenching and tempering to obtain a tempered martensitic structure.

However, the pressure vessel construction codes, for example the ASME code, do not always permit the use of tempered quenched steels.

The fact of reducing the contents of alloying elements to a minimum often makes it difficult to obtain the mechanical characteristics imposed by the same codes.

European Patent EP-0,021,349 proposes a steel with a high elastic limit, containing cobalt to improve the resistance to hydrogen cracking induced by the presence of $H_2S$.

However, this patent requires that the steel should be quenched and tempered.

Moreover, it clearly indicates that the quenching operation must be performed after a very fast austenitisation, at a rate of the order of 2° C./s, and this limits this steel to applications employing thin products which are therefore free from major segregated regions. In fact, this patent relates to steels for thin-walled tubes (not exceeding a few millimetres).

This patent indicates that cobalt would appear to act by forming a cobalt-enriched layer at the surface of the steel, slowing down the entry of hydrogen due to corrosion by $H_2S$.

This barrier is formed all the better the faster the austenitisation before quenching.

This patent also explains that the effect of cobalt is very weak when the structure is ferrite pearlite obtained either by normalisation or by controlled rolling.

Finally, it says nothing about the influence of cobalt on welding and on the suitability for cutting using gas cutting or plasma.

The problem raised above thus remains in its entirety.

The objective of the invention is therefore to find a means making it possible to improve the hydrogen cracking resistance of steels employed especially at great thickness and consequently containing segregated regions, while making it possible in particular to satisfy the codes of construction of pressure boiler forged equipment, whether the hydrogen enters the metal by corrosion in an acidic medium, such as wet $H_2S$, or during thermal soldering or cutting operations; consequently, the objective of the invention is also to improve the weldability and the suitability for cutting.

The subject of the invention is an agent intended to improve the hydrogen cracking resistance of steels employed especially in hydrogen-containing media and intended especially to improve the weldability and the suitability of these steels for cutting by thermal means, when they are intended for the production of thick pieces.

This agent is cobalt added in weight contents of between 0.05% and 2%.

The invention also relates to low-alloy steels intended especially for the production of boiler forged assemblies employed in $H_2S$-enriched media, with improved weldability and suitability for cutting, whose chemical weight composition comprises from 0.05% to 0.6% of carbon and less than 10% of alloying elements taken especially from silicon, manganese, nickel, chromium and molybdenum, and to which from 0.05% to 2% by weight of cobalt has also been added, the remainder consisting of iron and of residual impurities resulting from the melting of the substances during manufacture.

The chemical weight composition of these steels preferably comprises:

from 0.05% to 0.6% of carbon
less than 1% of silicon
less than 2% of manganese
less than 6% of nickel
less than 6% of chromium
less than 2% of molybdenum
from 0.05% to 2% of cobalt.

Carbide-forming elements such as vanadium or niobium may be preferably added in contents which may be up to 0.2%.

These steels correspond especially to the following steels:

A 516 all grades
A 515 all grades
A 537 class 1
A 633 all grades as defined by the American ASTM standard or the equivalent grades of other standards, to which from 0.05% to 2% of cobalt has been added; the use of these steels is imposed by the ASME pressure vessel construction code.

The invention also relates to a process for the manufacture of blocks, plates, bars, tubes or pieces, according to which a steel in accordance with the invention is produced, this steel is formed either by moulding pieces or by plastic deformation, while heated, of ingots, slabs, bars, billets or the like to obtain blocks, plates, bars, tubes or cast pieces, the said plates, bars, tubes or pieces undergo a normalising heat treatment at a temperature above $AC_3$ and optionally a tempering at a temperature below $AC_1$.

In another embodiment the blocks, plates, bars, tubes or pieces undergo a quenching treatment followed by a tempering.

The invention finally relates to any block, plate, bar, tube or piece produced from a steel forming the subject of the invention with the aid of the process according to the invention, the said blocks, plates, bars, tubes or pieces, exhibiting good hydrogen cracking resistance, good weldability and good suitability for cutting by thermal processes.

The smallest dimension of these blocks, plates, bars, tubes or pieces being greater than or equal to 5 mm and, in certain embodiments, this smallest dimension is greater than or equal to 200 mm.

The invention will be understood better with the aid of the description which is to follow, given solely by way of example and made with reference to the attached drawings, in which.

Figure 1:
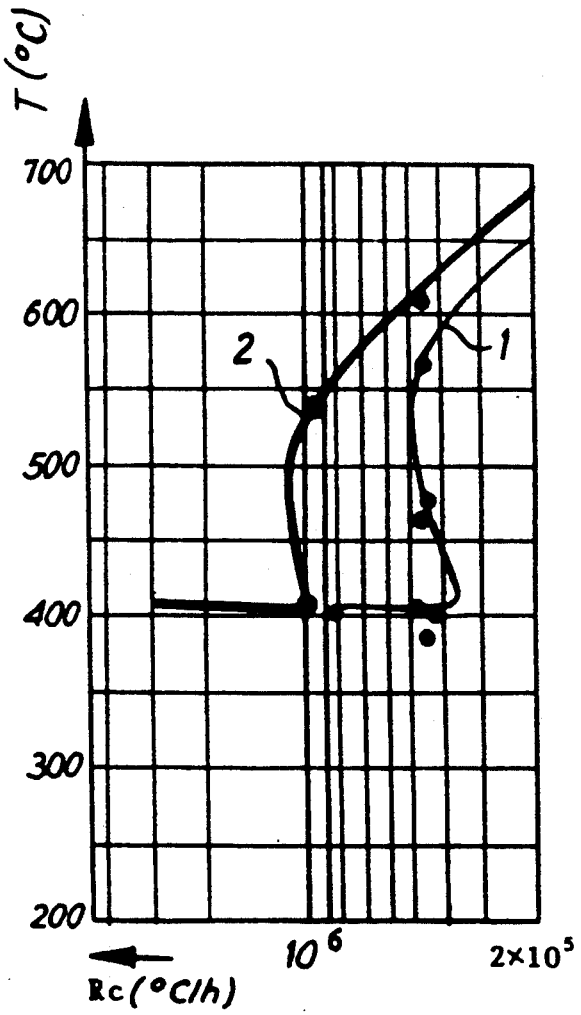
FIG. 1 represents continuous cooling transformation (CCT) diagrams for two steels taken as an example.

As already indicated above, cracks can be induced in low- or intermediate-alloy steels by the presence of hydrogen introduced by phenomena of the corrosion type in particular when the steel is in contact with $H_2S$-enriched gases, and this shortens the service life of plant operating in such conditions. The hydrogen may also be introduced either by a welding operation or by a thermal cutting operation, especially by conventional gas cutting or with the aid of a plasma torch; a hydrogen-sensitive steel will therefore have its weldability or its aptitude for cutting, that is to say its suitability for being welded or cut without the appearance of cracks, decreased.

A low- or intermediate-alloy steel means any steels employed especially in boiler forging, which contain from 0.05% to 0.6% of carbon and less than 10% of alloying elements taken nonexclusively from silicon, manganese, nickel, chromium, molybdenum and vanadium.

By way of guidance, this covers the steels whose chemical weight composition is situated within the following region:

from 0.05% to 0.6% of carbon
less than 1% of silicon
less than 2% of manganese
less than 6% of nickel
less than 6% of chromium
less than 2% of molybdenum.

Also, in particular, this covers the steels imposed by the pressure vessel construction codes such as the ASME code or similar codes.

These codes refer in particular to the American ASTM standard which defines especially the following steels:

A 516 all grades
A 515 all grades
A 537 class 1
A 633 all grades.

These steels and the equivalent steels of other standards existing in the world are affected by the invention.

In the case of all these steels, the hydrogen cracking sensitivity is linked in particular with the presence of segregations, that is to say of regions whose chemical composition is richer in carbon and in alloying elements than the average composition of the steels.

A person skilled in the art knows that these segregations are all the more important the more bulky the block or piece of steel, for example the thicker a sheet, the larger the diameter of a bar, and so on.

By way of guidance, the phenomenon becomes appreciable already when the thickness of a sheet exceeds 5 mm and becomes very appreciable when thicknesses of 100 mm are reached or exceeded.

The segregations accentuate the hydrogen cracking sensitivity of the steel because they are regions whose behaviour during the heat cycles to which the blocks, plates, bars, tubes or pieces are subjected is not the same as the average behaviour of the steel.

By way of example, during the cooling which follows a normalising treatment, while the bulk of the piece has a structure of the ferrite-pearlite type, the segregated regions may be "quenched" and may have a crude quenched martensitic structure which is very hard and very sensitive to hydrogen.

Similarly, during welding or gas cutting operations, in the vicinity of the welded joints or cuts the steel undergoes a thermal cycle which may result in hard and hydrogen-sensitive martensitic structures.

Similarly, after a quenching and tempering operation the segregated regions are harder and more brittle than the bulk of the blocks or pieces.

It has been found that cobalt decreases the detrimental effects of these segregated regions. Cobalt acting by two mechanisms:

first of all in the bulk of the blocks or pieces it is capable of trapping hydrogen, and this limits the hydrogen capable of reaching the segregated regions, furthermore, and above all, cobalt is an element which reduces the quenchability of the steel; this can be seen in FIG. 1 in which curve 1 corresponds to a steel without cobalt and curve 2 to the same steel to which 0.15% of cobalt has been added; the quenchability of the cobalt-free steel corresponds to a critical quenching rate of $3\times10^5$ °C./h, whereas in the case of the steel containing cobalt, this critical rate is higher than $10^6$ °C./h; the cobalt steel therefore quenches much less than the cobalt-free steel; because of this lower quenchability and of the segregation of cobalt, the segregated regions will be less easily quenched in the cobalt steel than in the cobalt-free steel, and this decreases the steel's sensitivity to hydrogen cracking.

The invention consists, therefore, of an agent, cobalt, which, when added in concentrations of between 0.05% and 2% to low- and intermediate-alloy steels, improves the hydrogen cracking resistance and consequently the weldability and the suitability for cutting by thermal means such as gas cutting, this agent acting:

on the one hand, by trapping a part of the hydrogen;

on the other hand, by decreasing the quenchability of the segregated regions.

The steel taken as an example in FIG. 1 has the following composition:

0.2% of carbon
1.1% of manganese
0.3% of silicon
0.25% of nickel
0.15% of chromium
0.05% of molybdenum with 0% of cobalt in one case (curve 1 of FIG. 1) and 0.15% of cobalt in the other case (curve 2 of FIG. 1).

Various comparative tests can be envisaged to demonstrate the effect of cobalt. The test for cracking on implants has been chosen, a method which is well known to a person skilled in the art, especially for assessing the resistance to cold cracking by hydrogen during welding operations.

However, this test can also make it possible to assess the effect of cobalt in the case of gas cutting operations on steels or of steels undergoing corrosion in a hydrogen-containing medium.

Figure 2:
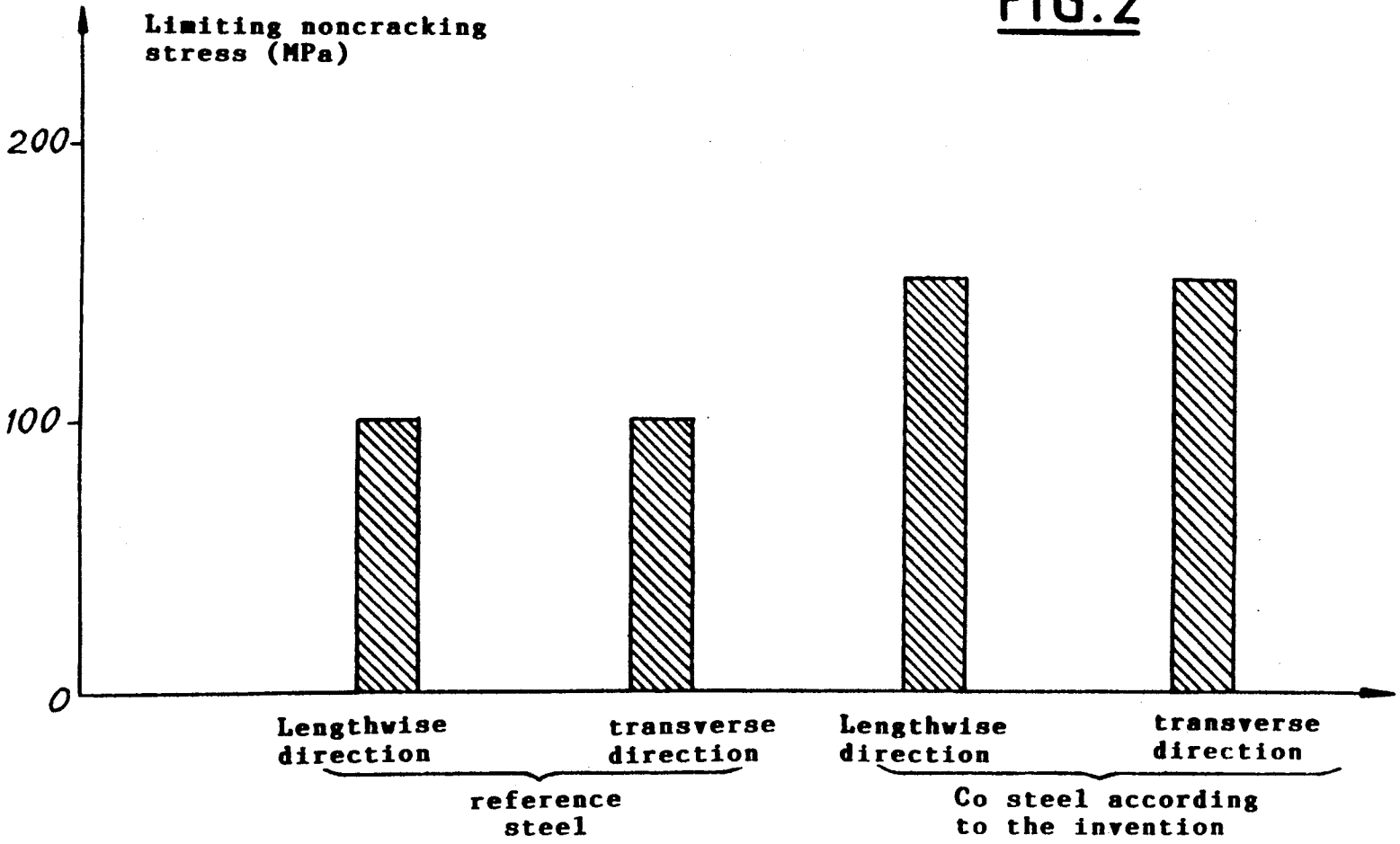
FIG. 2 is a diagram which gives the cracking limiting stresses measured on test welding specimens produced with the steels taken as an example.

To this end, simulations on implants intended to assess the limiting noncracking stress were performed on two steels of comparable analytical compositions, one of which contains no cobalt and the other of which contains 0.15% of cobalt. The results are illustrated in FIG. 2 which shows that, in the case of specimens taken lengthwise and transversely from plates, the limiting noncracking stress is:

100 MPa in the case of the cobalt-free steel

150 MPa in the case of the steel with cobalt, which demonstrates the favourable effect of cobalt.

This result has been confirmed by tests performed on eight steels:

two containing approximately 0.150% of carbon and 0% of Co two containing approximately 0.150% of carbon and 0.15% of Co two containing approximately 0.200% of carbon and 0% of Co two containing approximately 0.2% of carbon and 0.15% of Co.

Figure 3:
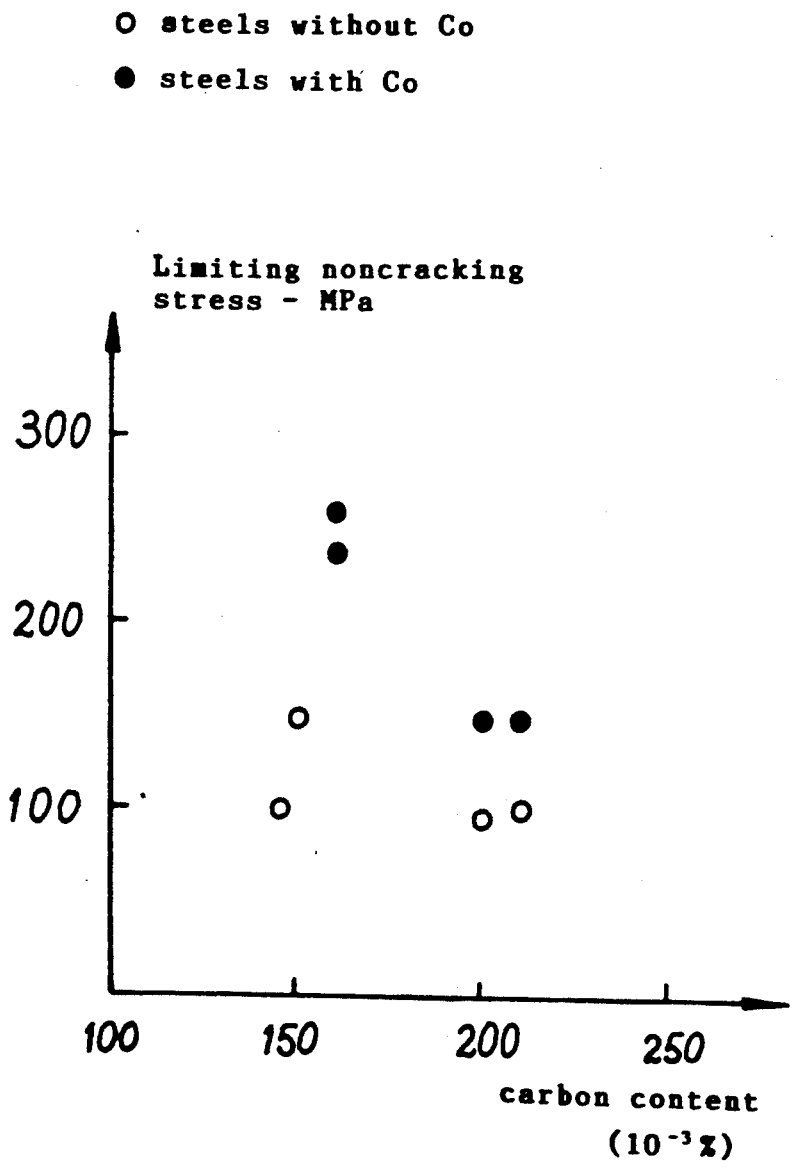
FIG. 3 is a generalisation of the results of FIG. 2 obtained for a plurality of steels differing in particular in the carbon content.

The results are illustrated in FIG. 3 and show that the cobalt steels have a higher limiting noncracking stress than the cobalt-free steels.

The difference between the noncracking stresses in the case of the steels with and without cobalt is approximately 100 MPa when the carbon content is approximately 0.150%, and 50 MPa when this content is approximately 0.2%.

Here again, the effect of cobalt is demonstrated because this limiting noncracking stress criterion is involved both in the case of hydrogen cracking induced by corrosion or during gas cutting, and in the case of that induced in the course of welding, and it should be noted that all the results presented were obtained on samples obtained after normalising and therefore having a ferrite-pearlite structure outside the segregated regions.

Since the effect of cobalt is sensitive to the carbon content, this effect can be improved by introducing carbide-forming elements such as vanadium and niobium into the steel, in contents of less than or equal to 0.2%. In fact, by forming carbides, these elements lower the "free" carbon content which on its own has a detrimental effect. The cobalt content can also be increased.

Naturally, the addition of cobalt does not in any way prevent the use of means which are known to a person skilled in the art for decreasing the sensitivity to hydrogen cracking, these means being in particular a good cleanness of the steel (nonmetallic inclusions are reduced to a minimum).

The invention also relates to the process which makes it possible to produce blocks, plates, bars, tubes or pieces by employing a steel into which cobalt has been introduced as an agent reducing the sensitivity to hydrogen embrittlement.

This process consists in:

manufacturing the steel according to the principles of the art adding cobalt in the desired content casting the steel to solidify it according to the principles of the art:

either in the form of semifinished products such as ingots, slabs, blooms or billets.

or in the form of cast pieces.

when a semifinished product is involved, in forming them by plastic deformation while heated by forging, rolling or any other equivalent means.

in performing a heat treatment according to the principles of the art to obtain the desired mechanical characteristics; this heat treatment may be a normalisation by heating to above $AC_3$ or a quenching, these treatments being optionally followed by tempering at a temperature below $AC_1$ or stress-relieving by being kept at a temperature of the order of 200° C.

Finally, the invention relates to any block, plate, bar, tube or piece obtained by the process just described by employing a steel to which cobalt has been added as an agent reducing the sensitivity to hydrogen cracking.

We claim:

1. Process for the manufacture of a metal part made of a low or intermediate alloy steel containing from 0.05% to 0.6% of carbon (weight percent) and less than 10% of at least one of the alloying elements silicon, manganese, nickel, chromium and molybdenum and resistant to hydrogen cracking, comprising:

adding from 0.05% to 2% (weight percent) of cobalt to the alloy steel, casting the alloy steel in the shape of the metal part or of a semi-finished product from which the metal part is obtained by plastic deformation, and normalizing the metal part by heating said metal part at a temperature above $AC_3$ of the alloy steel and then cooling the metal part for obtaining a substantially all ferrite-pearlite structure in the metal part.

2. Process according to claim 1, wherein the normalized metal part is tempered at a temperature below $AC_1$ of the alloy steel.

3. Process according to claim 1, wherein said low or intermediate alloy steel contains at least one of the carbide forming elements niobium and vanadium in a proportion of less than 0.2 weight %.

4. Process according to either of claims 1 or 2 wherein said low or intermediate alloy steel contains:

from b 0.05% to 0.6% of carbon less than 1% of silicon less than 2% of manganese less than 6% of nickel less than 6% of chromium less than 2% of molybdenum from 0.05% to 2% of cobalt.

5. Process according to claim 1, wherein the said low or intermediate alloy steel pertains to one of the types:

A 516 all grades

A 515 all grades

A 537 class 1

A 633 all grades as defined by the American ASTM standard or the analogous grades defined by other standards and whose use is imposed especially by the ASME pressure vessel construction code.

6. A metal part in the shape of a block, a plate, a bar, a tube or a cast piece produced by the process according to any one of claims 1 to 5.

7. A metal part according to claim 6, having a minimal dimension at least equal to 5 mm.

8. A metal part according to claim 6, having a minimal dimension at least equal to 100 mm.

* * * * *